US006416594B1

(12) United States Patent
Yamagami et al.

(10) Patent No.: US 6,416,594 B1
(45) Date of Patent: Jul. 9, 2002

(54) HEAT SHRINK BAND STEEL SHEET AND MANUFACTURING METHOD THEREOF

(75) Inventors: Nobuo Yamagami, Fukuyama; Kunikazu Tomita, Yokohama; Yasuyuki Takada; Yoshihiko Oda, both of Fukuyama; Hideki Matsuoka, Kasaoka; Tatsuhiko Hiratani, Fukuyama; Katsumi Nakajima, Fukuyama; Kenji Tahara, Fukuyama, all of (JP)

(73) Assignee: NKK Corporation, Tokyo (JP)

( * ) Notice: Subject to any disclaimer, the term of this patent is extended or adjusted under 35 U.S.C. 154(b) by 0 days.

(21) Appl. No.: 09/680,171

(22) Filed: Oct. 5, 2000

Related U.S. Application Data

(63) Continuation of application No. PCT/JP99/02819, filed on May 28, 1999.

(30) Foreign Application Priority Data

Mar. 4, 1999 (JP) ..... 11-056664

(51) Int. Cl.[7] ..... C21D 8/12; C22C 38/14

(52) U.S. Cl. ..... 148/306; 148/120; 148/121; 148/122

(58) Field of Search ..... 148/101, 100, 148/102, 120, 121, 122, 306

(56) References Cited

FOREIGN PATENT DOCUMENTS

| | | |
|---|---|---|
| JP | 3-87313 A | 4/1991 |
| JP | 8-6134 B2 | 1/1996 |
| JP | 10-208670 A | 8/1998 |
| JP | 10-214578 A | 8/1998 |
| JP | 11-209848 A | 8/1999 |

*Primary Examiner*—Deborah Yee
(74) *Attorney, Agent, or Firm*—Frishauf, Holtz, Goodman, & Chick, P.C.

(57) ABSTRACT

A heat shrink band steel sheet of the present invention comprises on the basis of percent in weight C: 0.1% or less, Si: 0.1% or less, Mn: 0.1 to 2%, P: 0.15% or less, S: 0.02% or less, sol Al: 0.08% or less, and N: 0.005% or less, or C: 0.005% or less, Si: 0.1% or less, Mn: 0.1 to 2%, P: 0.15% or less, S: 0.02% or less, sol Al: 0.08% or less, N: 0.005% or less, Ti: 0.02 to 0.06%, and B: 0.0003 to 0.005%, wherein the product of a magnetic permeability at the magnetic field of 0.3 Oe after heat shrinking treatment and a thickness (mm) is at least 350. A color CRT having a sufficient magnetic shielding characteristic and a less amount of color deviation can be realized by the steel sheet.

8 Claims, 4 Drawing Sheets

HEAT SHRINK BAND STEEL SHEET AND MANUFACTURING METHOD THEREOF

This application is a continuation application of International application PCT/JP99/02819 filed May 28, 1999.

TECHNICAL FIELD

The present invention relates to a heat shrink band steel sheet for tightening the panel of a color cathode-ray tube (CRT) used in televisions and the like and to a manufacturing method of it.

BACKGROUND ART

Since color CRTs are evacuated into a high vacuum of about $1\times10^{-7}$ Torr, the inevitable deformation of a panel surface by the atmospheric pressure has to be adjusted and the risk of the internal explosion of a tube must be avoided. For this purpose, so-called heat shrinking treatment is executed to applying tension for correcting the deformation of a panel surface by the following manner. That is, a heat shrink band composed of a steel sheet formed to a band shape is heated and expanded in the temperature range of about 400 to 600° C. for several seconds to several tens of seconds; put over the panel of a color CRT; and then cooled and shrunk.

Further, since the heat shrink band has a function for shielding a geomagnetism similarly to the internal magnetic shield, it prevents the occurrence of landing error of electron beams on the surface of a fluorescent member, that is, the occurrence of color deviation which is caused by the geomagnetism.

Mild steel has been used as a material of heat shrink band. However, since the magnetic permeability of the mild steel at the level of the geomagnetism (about 0.3 Oe) is about 200 and the magnetic shielding characteristic of the mild steel is not sufficient, there is required troublesome processes such as the adjustment of the position of a fluorescent member, and the like to prevent the color deviation caused by the geomagnetism.

Proposed in Japanese Patent Laid-Open No. 10-208670 as a method of improving the magnetic permeability of a material for a heat shrink band at the level of the geomagnetism is to hot roll and/or cold roll steel, which comprises on the basis of percent in weight $C\leqq0.005\%$, $2.0\%\leqq Si\leqq4.0\%$, $0.1\%\leqq Mn\leqq1.0\%$, $P\leqq0.2\%$, $S\leqq0.020\%$, sol $Al\leqq0.004\%$ or $0.1\%\leqq$sol $Al\leqq1.0\%$ and $N\leqq0.005\%$; to anneal the thus rolled steel sheet at 700 to 900° C.; and then to cold roll it at a reduction rate of 3 to 15%. It is shown that a heat shrink band having a magnetic permeability of at least 250 at 0.3 Oe and a sufficient magnetic shielding characteristic can be obtained by heating and cooling the steel sheet manufactured by the method.

However, when we actually applied the heat shrink band steel sheets made by the method disclosed in Japanese Patent Laid-Open No. 10-208670 to color CRTs, a sufficient magnetic shielding characteristic could not be always obtained.

DISCLOSURE OF THE INVENTION

An object of the present invention, which was made to solve these problems, is to provide a steel sheet for a heat shrink band having a sufficient magnetic shielding characteristic and capable of reliably realizing a color CRT with a less amount of color deviation and a manufacturing method of it.

The above object can be achieved by a steel sheet for a heat shrink band which comprises on the basis of percent in weight C: 0.1% or less, Si: 0.1% or less, Mn: 0.1 to 2%, P: 0.15% or less, S: 0.02% or less, sol Al: 0.08% or less, and N: 0.005% or less (hereinafter, the steel having the components is referred to as Steel 1), wherein the product of a magnetic permeability at the magnetic field of 0.3 Oe after heat shrinking treatment and a thickness (mm) is at least 350.

Further, a steel sheet for a heat shrink band which has a magnetic permeability, which is less deteriorated with aging can be obtained when the steel sheet for the heat shrink band comprises on the basis of percent in weight C: 0.005% or less, Si: 0.1% or less, Mn: 0.1 to 2%, P: 0.15% or less, S: 0.02% or less, sol Al: 0.08% or less, N: 0.005% or less, Ti: 0.02 to 0.06%, and B: 0.0003 to 0.005% (hereinafter, the steel having the components is referred to as Steel 2), wherein the product of a magnetic permeability at the magnetic field of 0.3 Oe after heat shrinking treatment and a thickness (mm) is at least 350.

A method of manufacturing the steel sheet having the components of Steel 1 comprises the steps of hot rolling and successively cold rolling the steel; annealing the cold rolled steel sheet in the temperature range of 650 to 900° C.; and subjecting the annealed steel sheet to overaging treatment in the temperature range of 250 to 500° C.

In contrast, in the case of the steel sheet having the components of Steel 2, it is preferable to anneal the cold rolled steel sheet in the temperature range of 800 to 900° C. In this case, overaging treatment is not always necessary after the annealing. However, the deterioration with aging of the magnetic permeability can be considerably reduced after heat shrinking treatment by executing the overaging treatment in the temperature range of 250 to 500° C.

The steel sheet can be skin-pass rolled after it is subjected to the overaging treatment or after it is annealed when it is not subjected to the overaging treatment likewise conventional steel sheets for the purpose of the improvement of the flatness of the steel sheet or the prevention of the occurrence of so-called stretcher-strain. In this case, a reduction rate must be set to 0.5% or less to prevent the deterioration of magnetic properties.

BEST MODE FOR CARRYING OUT THE INVENTION

We investigated the main factors of the color deviation of a color CRT, from the viewpoint of the properties of the steel sheet for a heat shrink band. As a result, we have found that the amount of Si and $\mu \times t$, which is the product of the magnetic permeability $\mu$ at the level of the geomagnetism of 0.3 Oe and the thickness t of the steel sheet, are important factors, the details of which will be described below.

1.) Relationship Between the Amount of Si and Amounts of the Drift Bh and Bv Attributable to the Geomagnetism Steels were smelted and cast in a laboratory, containing C: 0.02%, Mn: 0.15%, P: 0.01%, S: 0.01%, sol Al: 0.03%, N: 0.002% and various amounts of Si in the range of 0.01 to 0.2%. Thereafter, steel sheets having a thickness of 1.6 mm were made from the steels by hot rolling and cold rolling; annealed at 750° C. for 60 seconds; subjected to overaging treatment at 400° C. for 90 seconds; and formed to bands having a predetermined shape without being subjected to skin-pass rolling. Then, the steel bands were subjected to heat treatment at 500° C. for 60 seconds which corresponded to a heat shrinking treatment; put over the panel of a CRT for a 29-inch television. Thereafter, a drift test due to the geomagnetism was carried out and the amounts of the drift Bh and Bv attributable to the geomagnetism were determined in the following manner.

The amount of drift Bh is measured as the peak to peak value of the positional deviation (landing error) when a CRT is rotated by 360° around a vertical axis in the state that a vertical magnetic field of 0.35 Oe and a horizontal magnetic field of 0.30 Oe are applied to the CRT; whereas the amount of drift Bv is measured as the value of the positional deviation when the horizontal magnetic field is set to 0 Oe and the vertical magnetic field is changed from 0 to 0.35 Oe. The thus measured amounts of the drift Bh and Bv are intimately associated with a magnetic shielding characteristic. Namely, the smaller amounts of them result in the smaller amount of color deviation and the better anti-drift property.

Figure 1:
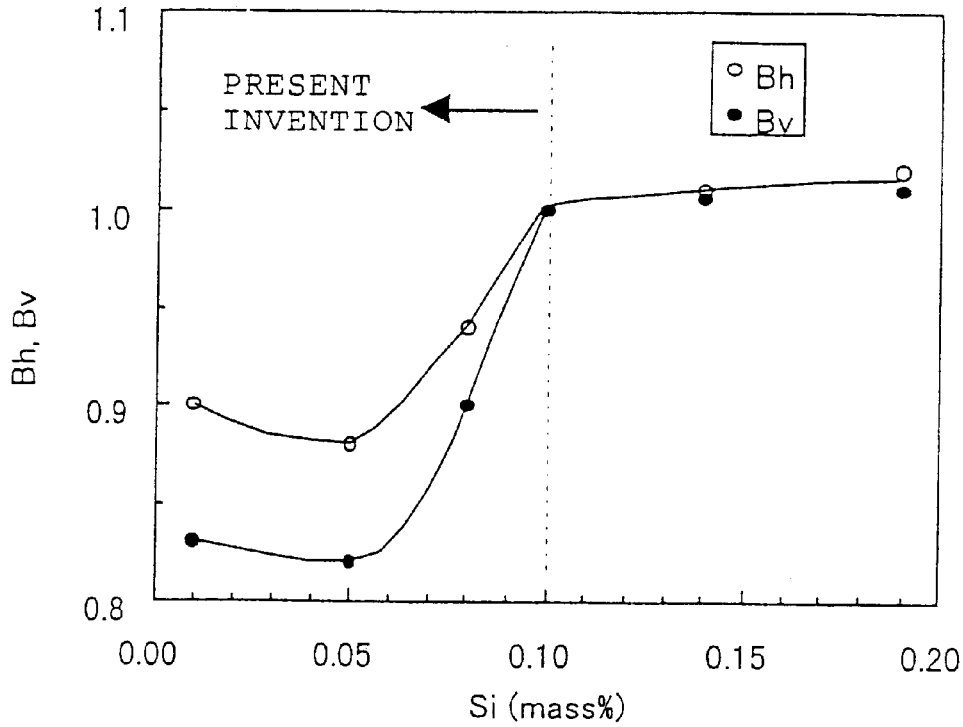
FIG. 1 is a graph showing the relationship between the amount of Si and the amounts of the drift Bh and Bv attributable to the geomagnetism.

FIG. 1 shows the relationship between the amount of Si and the amounts of the drift Bh and Bv attributable to the geomagnetism. In FIG. 1, Bh and Bv are represented by relative values when the value at Si of 0.1% is represented by 1.

It can be found that when the amount of Si is 0.1% or less, Bh and Bv are smaller than 1.0 and exhibit an excellent anti-drift property. In contrast, when Si exceeds 0.1%, Bh and Bv are somewhat increased from 1.0 and the anti-drift property exhibits a tendency for deterioration.

The result contradicts a tendency expected from the general knowledge that the magnetic permeability is improved by the increase of Si, that is, the tendency that as the amount of Si increases, the anti-drift property would be improved. Accordingly, we made an examination in more detail. As a result, it was found that when the amount of Si exceeded 0.1%, the close contact between a panel and a band was deteriorated and gaps were caused therebetween. It was considered that a magnetic shielding characteristic was deteriorated by the gaps, whereby the anti-drift property was deteriorated. The reason why the close contact was deteriorated by the increase of Si was not apparent. However, the gaps might be made by the deteriorated close contact which was caused through the shrinkage of the band in heat shrinking treatment because Si increased the strength of steel at high temperature.

It should be note that in the method disclosed in Japanese Patent Laid-Open No. 10-208670, design for strength for preventing the deformation of a panel surface and the internal explosion of a tube is restricted by the high yield strength of 40 kgf/mm$^2$ because at least 2% Si is contained; in contrast, in the present invention, the yield strength can be made to less than 40 kgf/mm$^2$ because Si content is set to 0.1% or less. Thus, the present invention has an advantage that a degree of freedom can be increased in the selection of materials in the design for strength, from the viewpoint of the strength of the steel sheet for the band.

The amounts of the components other than Si contained in the heat shrink band steel sheet must be also limited as described below in addition to the control of the amount of Si.

2.) Amounts of the components other than Si

C: C is an element which contributes to an increase of the strength of steel. However, since C is not preferable to magnetic permeability, the content of it is limited to 0.1% or less.

Mn: Since Mn is effective to an improvement of the ductility of steel during hot rolling and further contributes to an increase of the strength of steel by solid-solution hardening, the lower limit of it is restricted to 0.1%. In contrast, when the amount of Mn exceeds 2%, magnetic permeability is deteriorated. Thus, the content of it is limited to 2% or less. The content of Mn can be suitably selected within the above range according to the required strength level.

P: P is an element which contributes to an increase of the strength of steel and therefore can be added in a necessary amount. However, when it is added in an amount exceeding 0.15%, the steel sheet is made brittle and there is caused such a problem that a coil is broken in cold rolling. Therefore, the content of P is limited to 0.15% or less.

S: Since S is not preferable to both ductility during hot rolling and magnetic permeability, the content of it is limited to 0.02% or less.

sol Al: Since Al deteriorates formability, the content of it is limited to 0.08% or less.

N: N contributes to an increase of the strength of steel similarly to C. However, since N is not preferable to magnetic permeability, the content of it is limited to 0.005% or less and preferably to 0.003% or less.

In the components of Steel 1 , C is reduced to 0.005% or less, Ti is added in the amount of 0.02 to 0.06% and B is added in the amount of 0.0003 to 0.005% to thereby make the components of Steel 2. As a result, the solute carbon and the solute nitrogen in steel can be fixed as carbides and nitrides, whereby the deterioration of magnetic permeability with aging can be considerably reduced after heat shrinking treatment. Further, it is more preferable to limit C to 0.002% or less, Ti to 0.03% to 0.05% and B to 0.0003 to 0.001% respectively. The upper limits of Ti and B are provided to avoid the deterioration of magnetic permeability and ductility caused by the excessive addition of them.

The result in FIG. 1 shows the result obtained by the components of Steel 1. However, the same result can be also obtained by the components of Steel 2 which contains Ti and B as indispensable components.

3.) Relationship Between the $\mu \times t$ and the Amounts of the Drift Bh and Bv Steel having the components of Steel 2 in which contained were C: 0.002%, Si: 0.02%, Mn: 0.8%, P: 0.07%, S: 0.006%, sol Al: 0.04%, N: 0.002%, Ti: 0.04%, and B: 0.0008% was smelted and cast in a laboratory. Thereafter, steel sheets having a thickness of 0.8 to 1.6 mm were made by hot rolling and cold rolling; annealed at 850° C. or 870° C. for 90 seconds; subjected to overaging treatment at 450° C. for 2 minutes; and then formed to bands having a predetermined shape without being subjected to skin-pass rolling. The steel bands were subjected to heat treatment at 500° C. for 60 seconds which corresponded to heat shrinking treatment; and put over the panel of a CRT for a 29-inch television. Then, the amounts of drift Bh and Bv were determined by the above described drift test. Further, ring test pieces (inside diameter: 33 mm, outside diameter: 45 mm) were taken from the annealed steel sheets and subjected to heat treatment at 500° C. for 60 seconds which corresponded to heat shrinking treatment, and the magnetic permeability $\mu$ of the test pieces was measured at the magnetic field of 0.3 Oe, simulating the geomagnetism. At the same time, a steel sheet as a conventional material which had the components of C: 0.004%, Si: 0.01%, Mn: 0.21%, P: 0.015%, S: 0.013%, sol Al: 0.02%, and N: 0.002% was also annealed; subjected to averaging treatment; and skin-pass rolled at a reduction rate of 1%. Then, the same examination was conducted on the steel sheet for comparison.

Figure 2:
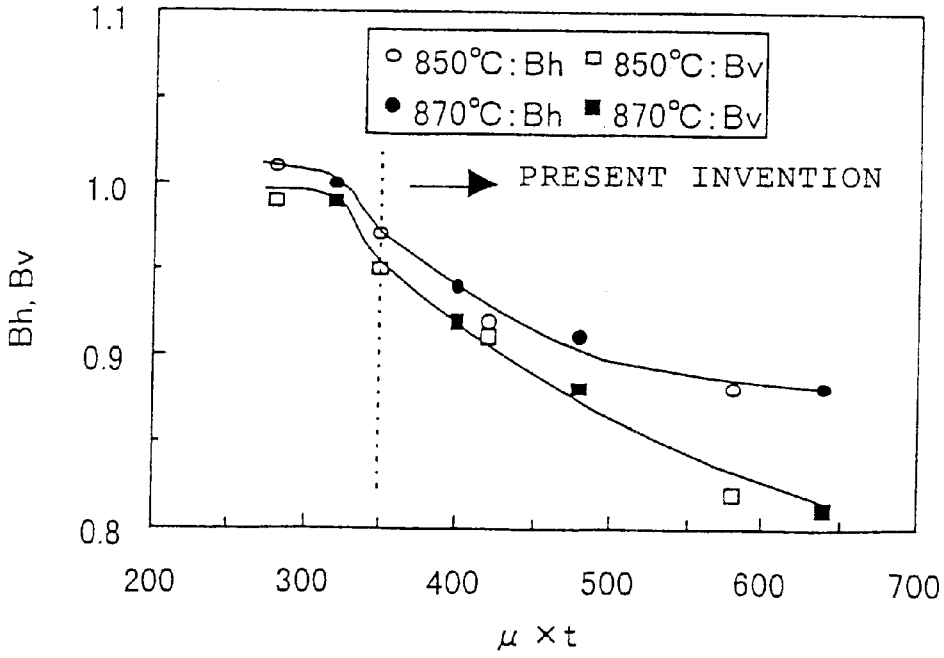
FIG. 2 is a graph showing the relationship between the $\mu\times t$ and the amounts of the drift Bh and Bv.

FIG. 2 shows the relationship between the $\mu$×t and the amounts of the drift Bh and Bv. Bh and Bv in FIG. 2 are represented by relative values when the value of the conventional material is represented by 1.

It can be found from FIG. 2 that the Bh and Bv of the steel sheet of the present invention are superior to those of the conventional material when $\mu$×t is 350 or larger, although both Bh and Bv of the steel sheet are about 1.0 until $\mu$×t reaches about 300 and are approximately the same as those of the conventional material.

It should be note that while the result in FIG. 2 shows the result obtained from the components of Steel 2, the same result can be also obtained in the components of Steel 1 which does not necessarily contain Ti and B.

To manufacture the steel sheet for the heat shrink band of the present invention, the steel sheet made by hot rolling and cold rolling under the ordinary conditions which are ordinarily employed in manufacturing steel sheets. However, the steel sheet for the shrink band of the present invention should be preferably annealed and subjected to overaging treatment under the conditions described below.

4.) Relationship Between the Annealing Temperature and the $\mu$×t.

Steel having the components of Steel 1 in which contained were C: 0.02%, Si: 0.03%, Mn: 0.10%, P: 0.01%, S: 0.007%, sol Al: 0.03%, and N: 0.002% was smelted and cast in a laboratory. Thereafter, steel sheets having a thickness of 1.0 mm were made by hot rolling and cold rolling; annealed at 500° C. to 900° C. for 60 seconds; and subjected to overaging treatment at 400° C. for 90 seconds. Then, ring test pieces were taken from the steel sheets without being subjected to skin-pass rolling. The ring test pieces were subjected to heat treatment at 500° C. for 60 seconds which corresponded to heat shrinking treatment; and the magnetic permeability $\mu$ of the test pieces was measured at the magnetic field of 0.3 Oe, simulating the geomagnetism.

Figure 3:
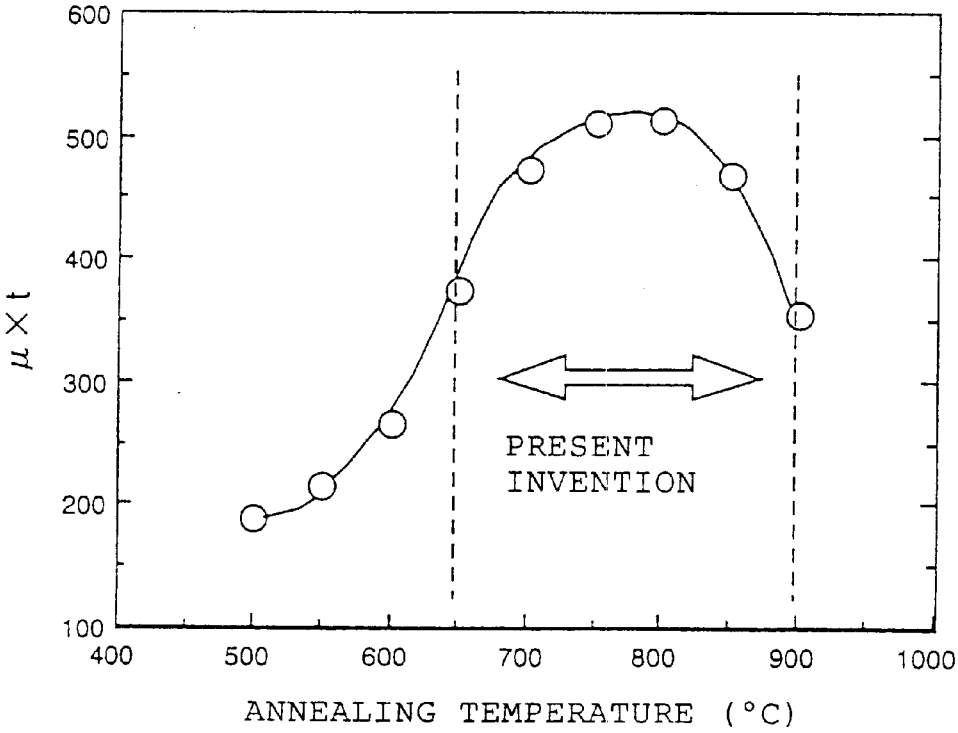
FIG. 3 is a graph showing the relationship between the annealing temperature and the $\mu\times t$ for Steel 1.

FIG. 3 shows the relationship between the annealing temperature and the $\mu$×t for Steel 1.

It can be found that annealing must be carried out in the temperature range of 650 to 900° C. to make $\mu$×t to at least 350 in the components of Steel 1.

Likewise, steel having the components of Steel 2 in which contained were C: 0.002%, Si: 0.01%, Mn: 0.30%, P: 0.08%, S: 0.005%, sol Al: 0.03%, N: 0.002%, Ti; 0.03%, and B: 0.0003% was smelted and cast in a laboratory. Thereafter, steel sheets having the thickness of 1.0 mm were made by hot rolling and cold rolling; annealed at 750° C. to 930° C. for 90 seconds; subjected to overaging treatment at 450° C. for 2 minutes; and further subjected to heat treatment which corresponded to heat shrinking treatment without being subjected to skin-pass rolling. Then, the magnetic permeability $\mu$ of the steel sheet was measured at the magnetic field of 0.3 Oe, simulating the geomagnetism.

Figure 4:
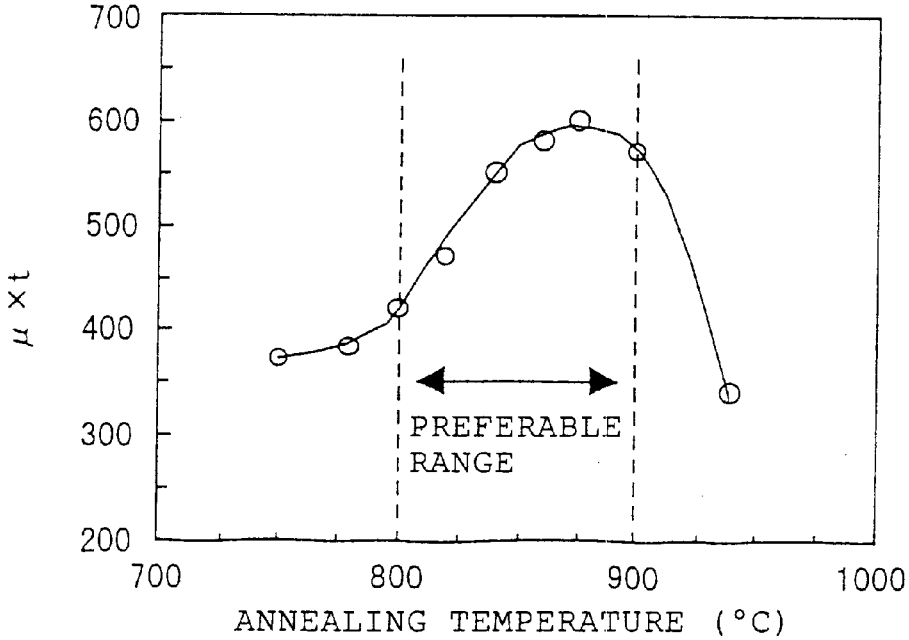
FIG. 4 is a graph showing the relationship between the annealing temperature and the $\mu\times t$ for Steel 2.

FIG. 4 shows the relationship between the annealing temperature and the $\mu$×t for the Steel 2.

It can be found that when annealing is carried out in the temperature range of 800 to 900° C. in the components of Steel 2, $\mu$×t is made to at least 400.

It is contemplated that the change of $\mu$×t caused by the annealing temperature as shown in FIGS. 3 and 4 corresponds to the microstructure of the steel sheet, that is, (1) when annealing is executed at a temperature lower than 650° C., $\mu$ is made small due to insufficient grain growth after recrystallization; (2) when annealing is executed at a temperature between 650 and 900° C., $\mu$ is improved through grain growth; and (3) when annealing is executed at a temperature exceeding 900° C., $\mu$ is lowered again because grains are fine due to the transformation.

5.) Relationship Between the Averaging Temperature and the $\mu$×t.

Steel having the components of Steel 1 in which contained were C: 0.03%, Si: 0.03%, Mn: 0.20%, P: 0.01%, S: 0.005%, sol Al: 0.04%, and N: 0.002% was smelted and cast in a laboratory. Thereafter, steel sheets having the thickness of 1.2 mm were made by hot rolling and cold rolling; annealed at 750° C. for 60 seconds; and subjected to overaging treatment at 150 to 550° C. for 90 seconds. Then, ring test pieces were taken from the steel sheets without being skin-pass rolled and subjected to heat treatment at 500° C. for 60 seconds which corresponded to heat shrinking treatment. Then, the magnetic permeability $\mu$ of the test pieces was measured at the magnetic field of 0.3 Oe, simulating the geomagnetism. Further, the magnetic permeability $\mu$ of the test pieces was also measured after they were heat treated at 150° C. for 100 hours to examine the aging behavior.

Figure 5:
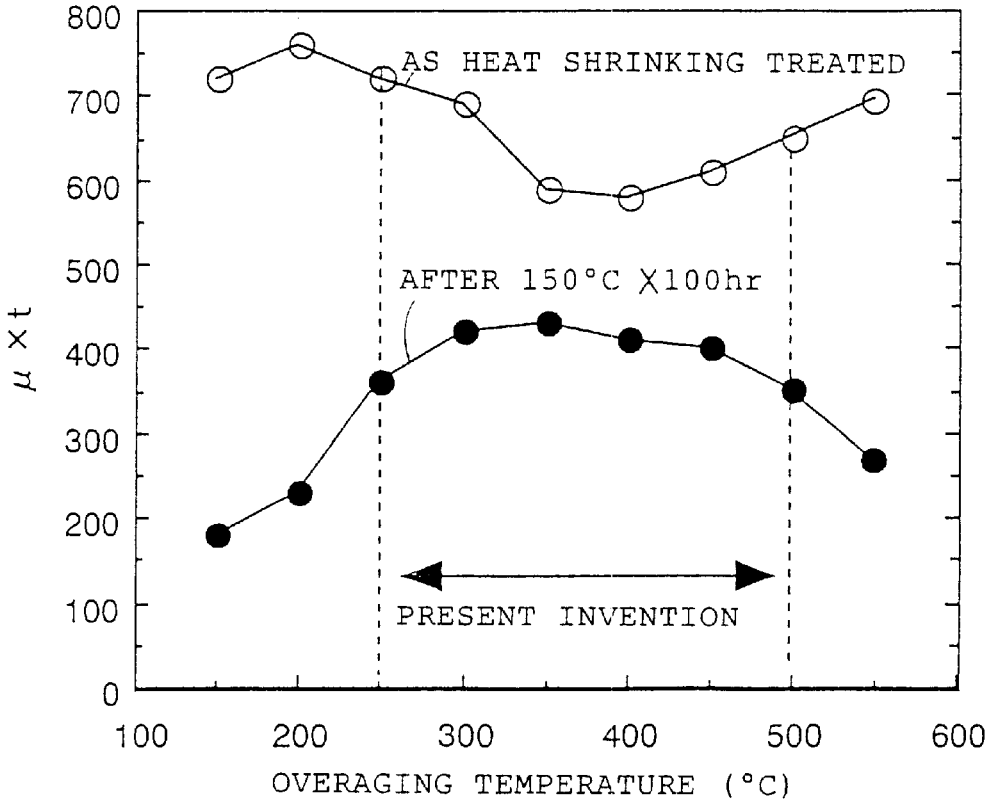
FIG. 5 is a graph showing the relationship between the averaging treatment temperature and the $\mu\times t$ for Steel 1.

FIG. 5 shows the relationship between the overaging temperature and $\mu$×t for Steel 1.

In the components of Steel 1, it can be found that overaging treatment must be carried out in the temperature range of 250 to 500° C. to secure $\mu$×t of at least 350 after the heat treatment executed at 150° C. for 100 hours.

Likewise, steel having the components of Steel 2 in which contained were C: 0.002%, Si: 0.01%, Mn: 1.0%, P: 0.07%, S: 0.006%, sol Al: 0.04%, N: 0.002%, Ti: 0.03%, and B: 0.0008% was smelted and cast in a laboratory. Thereafter, steel sheets having the thickness of 1.2 mm were made by hot rolling and cold rolling; annealed at 850° C. for 90 seconds; and subjected to overaging treatment at 170 to 550° C. for 2 minutes. Then, the steel sheets were subjected to heat treatment which corresponded to heat shrinking treatment without being subjected to skin-pass rolling; and further heat treated at 150° C. for 100 hours. Thereafter, the magnetic permeability $\mu$ of the steel sheet was measured at the magnetic field of 0.3 Oe, simulating the geomagnetism.

Figure 6:
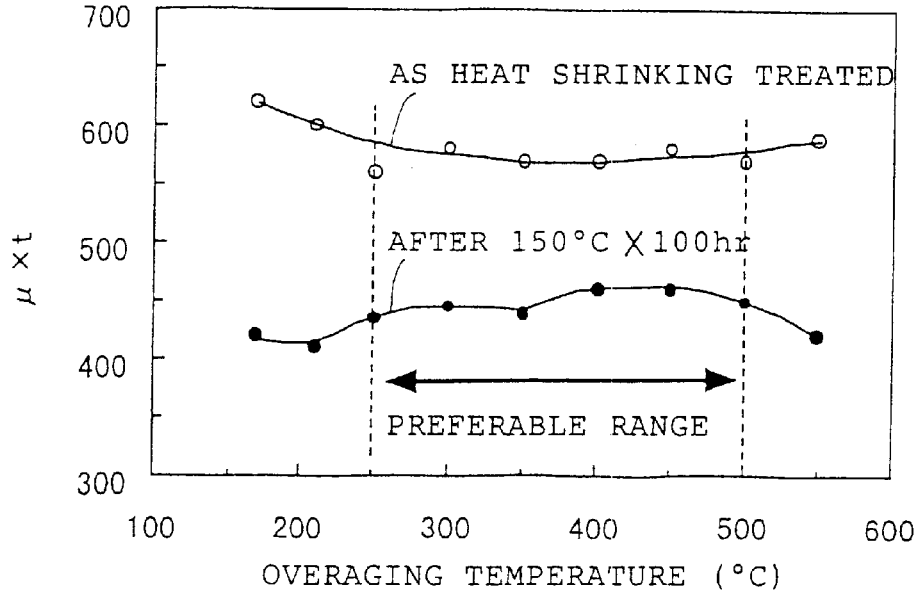
FIG. 6 is a graph showing the relationship between the averaging treatment temperature and the $\mu\times t$ for Steel 2.

FIG. 6 shows the relationship between the overaging temperature and the $\mu$×t for Steel 2.

It can be found that the effect of the aging treatment on $\mu$×t after the heat treatment executed at 150° C. for 100 hours is small and the overaging treatment is not always necessary in Steel 2. However, the execution of the overaging treatment at the temperature region of 250 to 500° C. is preferable because $\mu$×t exhibits a higher value after the heat treatment executed at 150° C. for 100 hours.

It is considered that the change of $\mu$×t caused by the overaging temperature as shown in FIGS. 5 and 6 is associated with the dissolution and precipitation behavior of carbides in steel. That is, solute carbon is produced by the partial dissolution of carbides in annealing. However, when the overaging temperature is too low, the solute carbon is not sufficiently precipitated even after the heat shrinking treatment and carbides are finely precipitated in the heat treatment executed after the heat shrinking treatment. Accordingly, even if the value of $\mu$ is high just after the heat shrinking treatment, it decreases thereafter. In contrast, when the overaging temperature is too high, the amount of solute carbon is increased after the heat shrinking treatment and carbides are finely precipitated in the heat treatment executed after the heat shrinking treatment, whereby the value of $\mu$ is lowered.

6.) Relationship Between the Skin-pass Rolling Reduction Rate and the $\mu \times t$ Steel having the components of Steel 2 in which contained were C: 0.003%, Si: 0.01%, Mn: 1.0%, P: 0.08%, S: 0.005%, sol Al: 0.04%, N:0.002%, Ti: 0.05% and B: 0.0007% was smelted and cast in a laboratory. Thereafter, steel sheets having the thickness of 1.0 mm were made by hot rolling and cold rolling; annealed at 850° C. for 90 seconds; subjected to overaging treatment at 450° C. for 2 minutes; and then skin-pass rolled at the reduction rate of 0 to 2%. Then, ring test pieces were taken from the steel sheets and subjected to heat treatment at 500° C. for 60 seconds which corresponded to heat shrinking treatment. Thereafter, the permeability $\mu$ of the test pieces was measured at the magnetic field of 0.3 Oe, simulating the geomagnetism.

Figure 7:
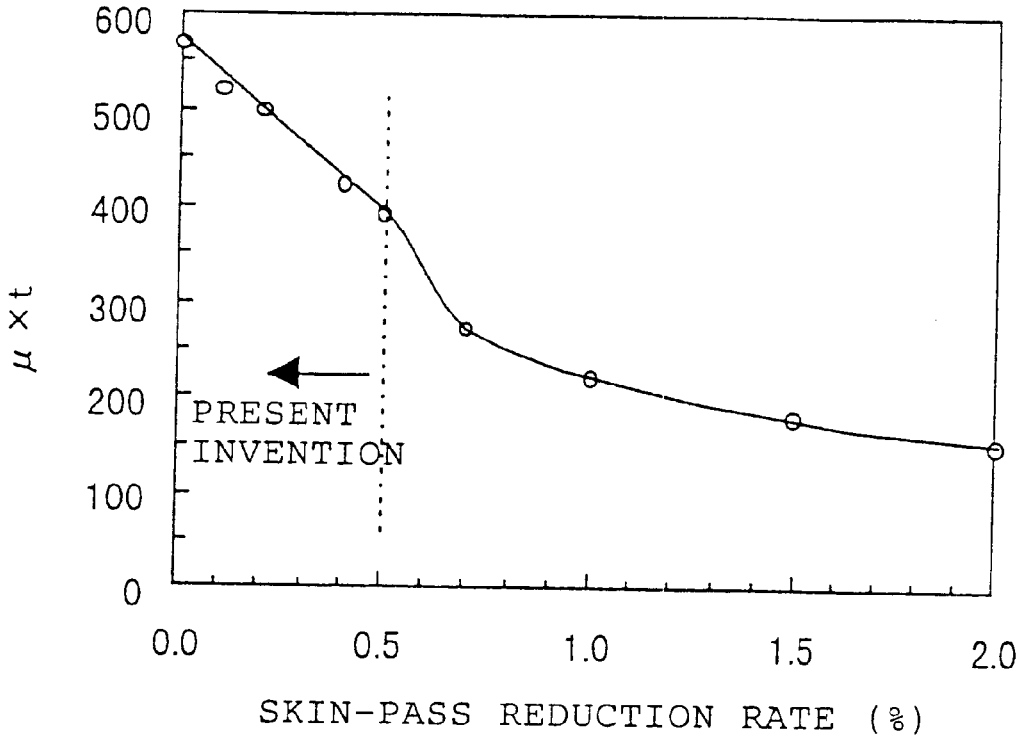
FIG. 7 is a graph showing the relationship between the skin-pass rolling reduction rate and the $\mu\times t$.

FIG. 7 shows the relationship between the skin-pass rolling reduction rate and the $\mu \times t$.

It can be found that when the skin-pass rolling reduction rate is 0.5% or less, $\mu \times t$ of at least 350 can be obtained. In contrast, when the reduction rate exceeds 0.5%, $\mu \times t$ is lowered to less than 350.

The result shown in FIG. 7 seems to be based on the phenomenon that when the reduction rate is 0.5% or less, strain might be only slightly introduced into the deeper region of the steel sheet from the surface by the skin-pass rolling, while strain might be relatively uniformly introduced only to the shallow region from the surface then.

In general, the steel sheet to be applied to press-forming is usually skin-pass rolled after annealing so that the flatness of the steel sheet is improved and the stretcher-strain is prevented at press-forming. However, in the case of a heat shrink band, it is preferable that the skin-pass rolling reduction rate is as low as possible from the view point of preventing the deterioration of magnetic properties, because the steel sheet is not severely formed in manufacturing the band. Thus, when there is no problem in the surface appearance of the band, the skin-pass rolling may be preferably omitted.

While the result in FIG. 7 shows the result obtained from the components of Steel 2, the same result can be also obtained from the components of Steel 1 which does not necessarily contain Ti and B.

The heat shrink band may be plated from the view point of corrosion resistance. Even in such a case, the same properties can be obtained when the characteristics of the steel sheet before it is plated satisfy the requirements of the present invention.

EXAMPLE 1

Steels A to G having the components shown in Table 1 were smelted and cast into slabs. The slabs were reheated to 1200° C. and hot rolled to steel sheets having the thickness of 3.2 mm at the finishing temperature of 820° C. and coiled at 680° C. The hot-rolled sheets were cold rolled to a thickness of 0.8 to 1.6 mm after being pickled, annealed at 500 to 850° C. for 90 seconds, and then subjected to overaging treatment at 150 to 350° C. for 2 minutes.

The steel sheets were further subjected to heat treatment at 500° C. for 5 seconds which corresponded to heat shrinking treatment and air-cooled to room temperature. Thereafter, the direct current magnetic properties (permeability at 0.3 Oe and coercive force when the steel sheets were magnetized up to 0.5T) were measured using ring test pieces. To evaluate the magnetic stability, the magnetic properties were also measured after the heat treatment at 150° C. for 100 hours. Further, the drift test described above was conducted after forming the steel sheets to bands having a predetermined shape, heating the bands to 500° C. and putting them over the panel of a CRT for a 29-inch television.

Table 2 shows the results. The amounts of drift Bh and Bv shown in this table were represented by relative values when the amounts of them for the steel sheet made by a conventional method, which received a 1% skin-pass rolling, was represented by 1.

As shown in Table 2, it can be found that the steel sheets made by the present invention method have $\mu \times t$ of at least 350 at the magnetic field of 0.3 Oe, are excellent in the anti-drift property and exhibit stable magnetic properties.

In contrast, the specimens made by the conventional methods have $\mu \times t$ less than 350 and an inferior anti-drift property. Therefore, they require troublesome processes to reduce the color deviation.

TABLE 1

(mass %)

| Steel | C | Si | Mn | P | S | sol.Al | N | Reference |
|---|---|---|---|---|---|---|---|---|
| A | 0.020 | 0.01 | 0.20 | 0.05 | 0.007 | 0.03 | 0.0020 | Invention |
| B | 0.060 | 0.05 | 0.5 | 0.04 | 0.01 | 0.05 | 0.0020 | |
| C | 0.003 | 0.02 | 0.15 | 0.08 | 0.002 | 0.02 | 0.0025 | |
| D | 0.150 | 0.02 | 0.3 | 0.04 | 0.09 | 0.04 | 0.0022 | Com- |
| E | 0.030 | 0.01 | 2.5 | 0.01 | 0.08 | 0.04 | 0.0014 | parison |
| F | 0.040 | 0.12 | 0.15 | 0.05 | 0.08 | 0.06 | 0.0022 | |
| G | 0.003 | 0.02 | 0.3 | 0.09 | 0.004 | 0.01 | 0.0068 | |

TABLE 2

| | Annealing | | Overaging | Skin-pass reduction | As heat shrinking treated | | After 150° C. × 100 hr | | | | |
|---|---|---|---|---|---|---|---|---|---|---|---|
| Steel | temp. (° C.) | Thickness (mm) | temp. (° C.) | rate (%) | $\mu \times t$ | Coercive force (Oe) | $\mu \times t$ | Coercive force (Oe) | Bh | Bv | Reference |
| A | 750 | 1.2 | 350 | 0.0 | 560 | 1.35 | 410 | 1.46 | 0.92 | 0.89 | Invention |
| | 650 | 1.2 | 350 | 0.0 | 510 | 1.39 | 400 | 1.45 | 0.94 | 0.91 | |
| | 850 | 1.2 | 350 | 0.4 | 490 | 1.22 | 400 | 1.48 | 0.91 | 0.88 | |
| | 500 | 1.2 | 350 | 0.0 | 320 | 1.77 | 250 | 1.86 | 1.01 | 1.00 | Comparison |
| | 750 | 1.2 | 350 | 1.0 | 240 | 1.75 | 220 | 1.93 | 1.00 | 1.00 | |
| | 750 | 1.2 | 150 | 0.0 | 540 | 1.29 | 170 | 2.21 | — | — | |
| B | 700 | 1.2 | 350 | 0.0 | 560 | 1.45 | 410 | 1.51 | 0.92 | 0.89 | Invention |
| C | 800 | 1.0 | 350 | 0.5 | 540 | 1.38 | 420 | 1.42 | 0.89 | 0.88 | |

TABLE 2-continued

| Steel | Annealing temp. (° C.) | Annealing Thickness (mm) | Overaging temp. (° C.) | Skin-pass reduction rate (%) | As heat shrinking treated μ × t | As heat shrinking treated Coercive force (Oe) | After 150° C. × 100 hr μ × t | After 150° C. × 100 hr Coercive force (Oe) | Bh | Bv | Reference |
|---|---|---|---|---|---|---|---|---|---|---|---|
| D | 800 | 1.2 | 350 | 0.5 | 280 | 1.78 | 160 | 1.81 | 1.01 | 0.99 | Comparison |
| E | 800 | 1.2 | 350 | 0.5 | 220 | 1.85 | 200 | 1.98 | 1.01 | 1.02 | |
| F | 750 | 1.2 | 350 | 0.2 | 230 | 1.84 | 210 | 1.93 | 1.02 | 1.00 | |
| G | 750 | 1.6 | 350 | 0.0 | 340 | 1.81 | 220 | 1.82 | 1.01 | 1.02 | |

EXAMPLE 2

Steels H to O having the components shown in Table 3 were smelted and cast into slabs. The slabs were reheated to 1200 to 1280° C. and hot rolled to steel sheets having the thickness of 3.2 mm at the finishing temperature of 900° C. and coiled at 680° C. The hot-rolled sheets were cold rolled to a thickness of 0.8 to 1.6 mm after being pickled, annealed at 800 to 950° C. for 90 seconds, and then subjected to overaging treatment at 210 to 550° C. for 2 minutes.

The steel sheets were further subjected to heat treatment similar to that of the example 1 which corresponded to heat shrinking treatment. Thereafter, the direct current magnetic properties (permeability at 0.3 Oe and coercive force when the steel sheets were magnetized up to an external magnetic field of 10 Oe) were measured using ring test pieces. The magnetic stability and the drift property were evaluated in a manner similar to that of the example 1.

Table 4 shows the results. The amounts of drift Bh and Bv shown in this table were represented by relative values when the amounts of them for the steel sheet, which contained C: 0.03%, Si: 0.03%, Mn: 0.25%, P: 0.015%, S: 0.007%, sol Al: 0.05%, and N: 0.0020% and was made by a conventional method at the skin-pass reduction rate of 1%, was represented by 1.

As shown in Table 4, it can be found that the steel sheets made by the present invention methods have μ×t of at least 350 at the magnetic field of 0.3 Oe, are excellent in the anti-drift property, and exhibit more stable magnetic properties.

In contrast, the specimens made by the conventional methods have μ×t less than 350 and an inferior anti-drift property. Therefore, they require troublesome processes to reduce the color deviation.

TABLE 3

(mass %)

| Steel | C | Si | Mn | P | S | sol.Al | N | Ti | B | Reference |
|---|---|---|---|---|---|---|---|---|---|---|
| H | 0.002 | 0.01 | 1.00 | 0.075 | 0.006 | 0.03 | 0.0020 | 0.04 | 0.0003 | Invention |
| I | 0.003 | 0.03 | 0.74 | 0.043 | 0.008 | 0.04 | 0.0024 | 0.05 | 0.0008 | |
| J | 0.002 | 0.02 | 0.96 | 0.078 | 0.002 | 0.04 | 0.0018 | 0.03 | 0.0006 | |
| K | 0.001 | 0.01 | 1.89 | 0.068 | 0.011 | 0.05 | 0.0014 | 0.02 | 0.0014 | |
| L | 0.005 | 0.01 | 0.30 | 0.085 | 0.004 | 0.03 | 0.0026 | 0.06 | 0.0005 | |
| M | 0.003 | 0.15 | 1.34 | 0.059 | 0.003 | 0.04 | 0.0023 | 0.03 | 0.0011 | Comparison |
| N | 0.003 | 0.01 | 2.60 | 0.036 | 0.008 | 0.04 | 0.0019 | 0.05 | 0.0006 | |
| O | 0.002 | 0.02 | 0.92 | 0.082 | 0.006 | 0.03 | 0.0074 | 0.02 | 0.0004 | |

TABLE 4

| Steel | Annealing temp. (° C.) | Annealing Thickness (mm) | Overaging temp. (° C.) | Skin-pass reduction rate (%) | As heat shrinking treated μ × t | As heat shrinking treated Coercive force (Oe) | After 150° C. × 100 hr μ × t | After 150° C. × 100 hr Coercive force (Oe) | Bh | Bv | Reference |
|---|---|---|---|---|---|---|---|---|---|---|---|
| H | 800 | 1.2 | 410 | 0.0 | 490 | 2.01 | 390 | 2.19 | 0.92 | 0.91 | Invention |
| | 900 | 1.2 | 470 | 0.0 | 600 | 1.92 | 450 | 2.44 | 0.88 | 0.87 | |
| | 850 | 1.2 | 450 | 0.0 | 650 | 1.64 | 500 | 1.91 | 0.87 | 0.85 | |
| | 870 | 1.2 | 480 | 0.4 | 540 | 1.82 | 430 | 2.21 | 0.90 | 0.89 | |
| | 830 | 1.2 | 420 | 0.0 | 520 | 1.91 | 430 | 2.17 | 0.90 | 0.90 | |
| | 855 | 1.2 | 210 | 0.0 | 660 | 1.60 | 430 | 2.20 | 0.87 | 0.85 | |
| | 860 | 1.2 | 550 | 0.0 | 670 | 1.60 | 440 | 2.16 | 0.87 | 0.84 | |
| | 950 | 1.2 | 480 | 0.0 | 340 | 2.43 | 270 | 2.98 | 1.01 | 1.00 | Comparison |
| I | 850 | 1.2 | 450 | 0.0 | 670 | 1.62 | 530 | 1.88 | 0.87 | 0.84 | Invention |
| J | 860 | 0.8 | 450 | 0.1 | 430 | 1.65 | 350 | 1.91 | 0.91 | 0.90 | |
| K | 840 | 1.2 | 450 | 0.0 | 540 | 1.95 | 440 | 2.26 | 0.90 | 0.89 | |
| L | 850 | 1.0 | 450 | 0.5 | 420 | 2.09 | 340 | 2.31 | 0.93 | 0.92 | |
| M | 850 | 1.2 | 450 | 0.0 | 720 | 1.28 | 560 | 1.67 | 1.01 | 1.00 | Comparison |
| N | 850 | 1.2 | 450 | 0.0 | 340 | 2.39 | 260 | 3.10 | 1.01 | 1.00 | |
| O | 850 | 1.2 | 450 | 0.0 | 340 | 2.52 | 230 | 3.41 | 1.01 | 1.00 | |

What is claimed is:

1. A heat shrink band cold rolled steel sheet comprising on the basis of percent in weight C: 0.005% or less, Si: 0.1% or less, Mn: 0.1 to 2%, P: 0.15% or less, S: 0.02% or less, sol Al: 0.08% or less, N: 0.005% or less, Ti: 0.02 to 0.06%, and B: 0.0003 to 0.005%, wherein the product of a magnetic permeability at the magnetic field of 0.3 Oe after heat shrinking treatment and a thickness (mm) is at least 350.

2. A manufacturing method of a heat shrink band steel sheet comprising the steps of:

making a steel sheet by hot rolling and successively cold rolling the steel comprising on the basis of percent in weight C: 0.1% or less, Si: 0.1% or less, Mn: 0.1 to 2%, P: 0.15% or less, S: 0.02% or less, sol Al: 0.08% or less, and N: 0.005% or less;

annealing the cold rolled steel sheet in the temperature range of 650 to 900° C.; and subjecting the annealed steel sheet to overaging treatment in the temperature range of 250 to 500° C.

3. A manufacturing method of a heat shrink band steel sheet comprising the steps of:

making a steel sheet by hot rolling and successively cold rolling the steel comprising on the basis of percent in weight C: 0.005% or less, Si: 0.1% or less, Mn: 0.1 to 2%, P: 0.15% or less, S: 0.02% or less, sol Al: 0.08% or less, N: 0.005% or less, Ti: 0.02 to 0.06%, and B: 0.0003 to 0.005%; and annealing the cold rolled steel sheet in the temperature range of 800 to 900° C.

4. A manufacturing method of a heat shrink band steel sheet comprising the steps of:

making a steel sheet by hot rolling and successively cold rolling the steel comprising on the basis of percent in weight C: 0.005% or less, Si: 0.1% or less, Mn: 0.1 to 2%, P: 0.15% or less, S: 0.02% or less, sol Al: 0.08% or less, N: 0.005% or less, Ti: 0.02 to 0.06%, and B: 0.0003 to 0.005%;

annealing the cold rolled steel sheet in the temperature range of 800 to 900° C., and overaging treatment in the temperature range of 250 to 500° C. after the annealing step.

5. A manufacturing method according to claim 2, further comprising the step of skin-pass rolling executed at a reduction rate of 0.5% or less after the overaging step.

6. A manufacturing method according to claim 4, further comprising the step of skin-pass rolling executed at a reduction rate of 0.5% or less after the annealing step.

7. A manufacturing method according to claim 4, further comprising the step of skin-pass rolling executed at a reduction rate of 0.5% or less after the averaging step.

8. A heat shrink band made of the cold rolled steel sheet comprising on the basis of percent in weight C: 0.005% or less, Si: 0.1% or less, Mn: 0.1 to 2%, P: 0.15% or less, S: 0.02% or less, sol Al: 0.08% or less, N: 0.005% or less, Ti: 0.02 to 0.06%, and B: 0.0003 to 0.005%, wherein the product of a magnetic permeability at the magnetic field of 0.3 Oe after heat shrinking treatment and a thickness (mm) is at least 350.

* * * * *